US005265278A

United States Patent [19]

Watanabe

[11] Patent Number: 5,265,278

[45] Date of Patent: Nov. 30, 1993

[54] HAIR CAP

[76] Inventor: Hideki Watanabe, 282-4 Hanawase, Makabe-cho, Makabe-gun, Ibaraki-ken, Japan

[21] Appl. No.: 913,514

[22] Filed: Jul. 14, 1992

[51] Int. Cl.[5] ..... A42B 1/04

[52] U.S. Cl. ..... 2/174; 2/200.1

[58] Field of Search ..... 2/7, 10, 15, 68, 171, 2/173, 174, 195, 200, 410, 411, 412, 171.2; 34/96; 128/380

[56] References Cited

U.S. PATENT DOCUMENTS 3,302,653 2/1967 D'Agostino ..... 2/174
3,320,682 5/1967 Sliman ..... 128/380
3,746,015 7/1973 Schulman ..... 2/174
4,428,079 1/1984 McKee ..... 2/174
4,785,476 11/1988 Longworth ..... 2/7
4,914,754 4/1990 Ruth ..... 2/171

*Primary Examiner*—Clifford D. Crowder
*Assistant Examiner*—Diana L. Biefeld

[57] ABSTRACT

A hair cap has a ceramic paper cap of a ceramic paper material sandwiched between an inner cap and an outer cap which are both formed of an impermeable synthetic resin material and when used in permanent wave hairdressing or bathing, will encourage the waving or curling of the hair and the metabolization of the head skin with the heating action of far infrared rays emitted from the ceramic paper cap.

6 Claims, 8 Drawing Sheets

HAIR CAP

BACKGROUND OF THE INVENTION

The present invention relates to a hair cap for use in permanent wave hairdressing or bathing.

A known hair cap used in permanent wave hairdressing is provided in the form of a vinyl cap made of an impermeable vinyl material for averting the escape of a resultant ammonia gas to a room or a heat insulating cap having an absorption layer of a resilient foamed plastic material arranged on the inner side thereof for cold-wave hairdressing.

Such a vinyl cap for preventing the escape of an ammonia gas will hardly provide a heat insulating effect nor improve the action of relevant processing.

Also, such a heat insulating cap for cold-wave hairdressing will be bulky in size and heavy in weight due to the presence of the absorption layer although it can provide a heat insulating effect. Above all, the absorption layer has to be replaced with a new one in every use.

SUMMARY OF THE INVENTION

It is an object of the present invention, for overcoming the foregoing disadvantages, to provide an improved hair cap which is compact in size, light in weight, and capable of reuse and also, can provide a heat insulating effect and minimize the duration for hair treatment action.

It is another object of the present invention to provide a hair cap which when used in bathing, can activate the hair and the head skin.

Other objects and novel features of the present invention will be apparent from reading the detailed description in conjunction with the accompanying drawings.

The drawings are provided for ease of the description and are not intended to limit the scope of the present invention.

DESCRIPTION OF THE PREFERRED EMBODIMENTS

Figure 1:
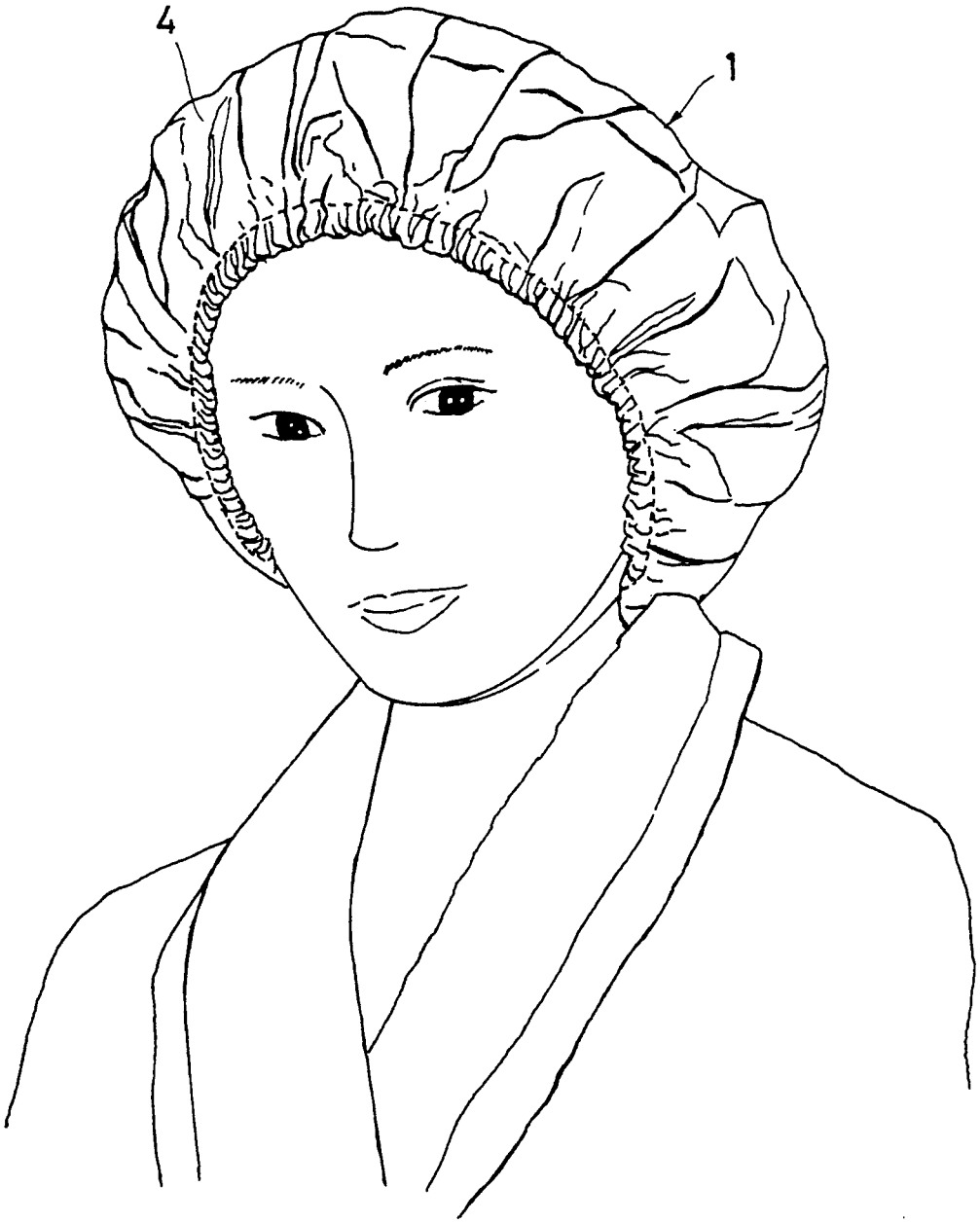
FIG. 1 is an explanatory view showing the use of a first embodiment of the present invention.
Figure 2:
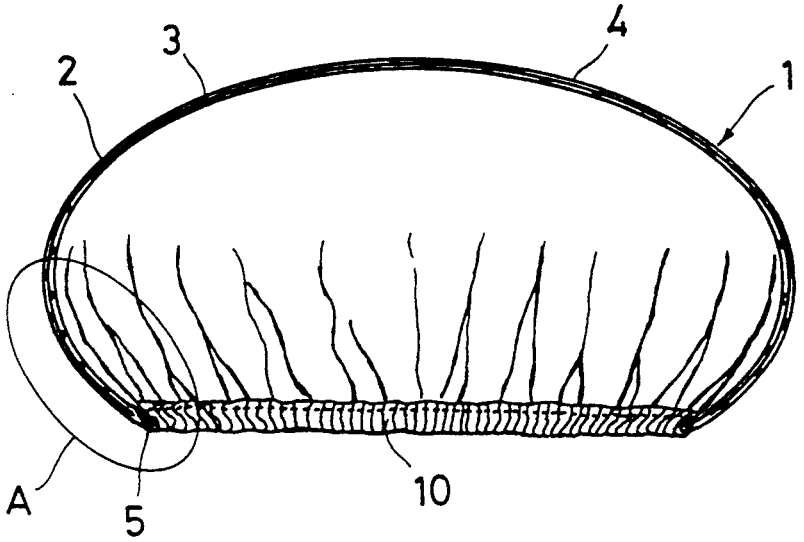
FIG. 2 is a cross sectional view of the first embodiment.
Figure 3:
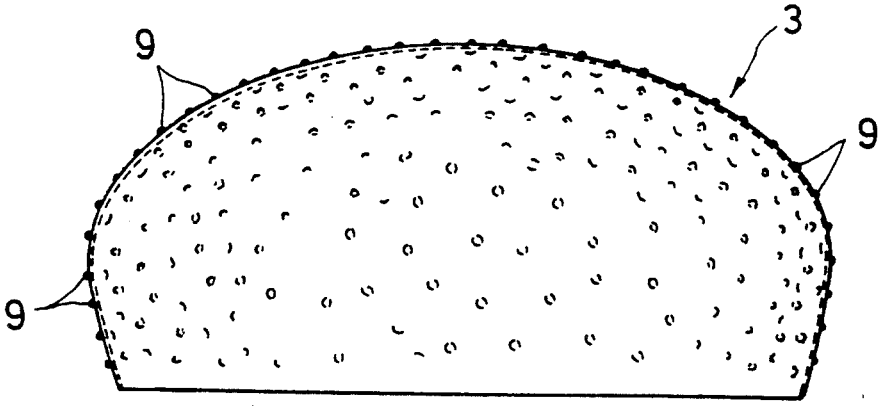
FIG. 3 is an explanatory view of a ceramic paper cap.
Figure 4:
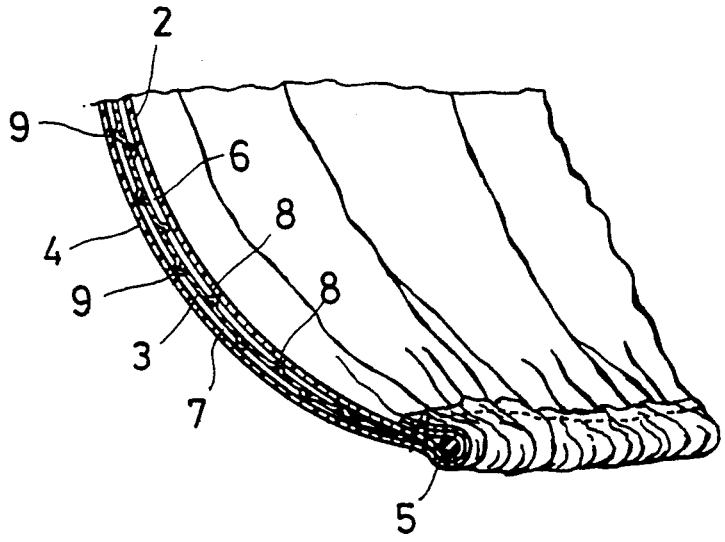
FIG. 4 is an enlarged cross sectional view of the section denoted by the letter A in FIG. 2.
Figure 5:
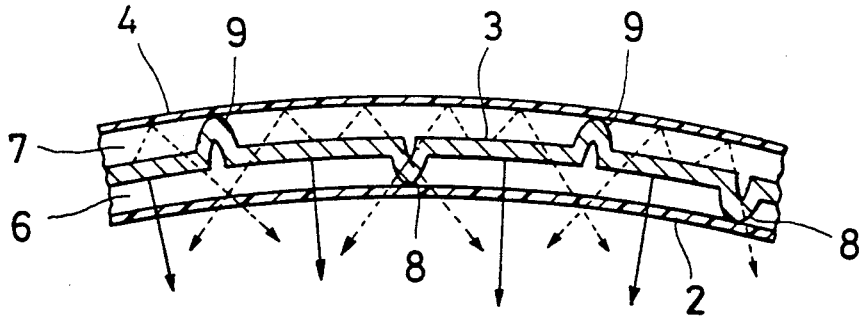
FIG. 5 is an explanatory view showing the radiation of far infrared rays in the first embodiment.

Preferred embodiments of the present invention will be described referring to the accompanying drawings.

FIGS. 1 to 5 show a first embodiment of the present invention in the form of a hair cap 1 which can cover over the hair being rolled on lots. More specifically, the hair cap 1 comprises an inner cap 2 made of a synthetic resin material, e.g. vinyl. A ceramic paper cap 3 of a hair cap shape made of a far infrared ceramic paper material, which exhibits a resistance to heat up to 80° C. and is coated with a polyethylene coating, is arranged to cover over the outer surface of the inner cap 2. An outer cap 4 made of a synthetic resin, e.g. impermeable polyethylene or vinyl, is arranged to cover over the outer surface of the ceramic paper cap. A rubber string 5 having an annular shape is enclosed in the opening hem of the outer cap 4 as it is sewed down or bonded to the opening end of the same.

The inner cap 2 is colored black for optimum transmission of the far infrared rays from the ceramic paper cap 3.

The ceramic paper cap 3 may be provided in the form of a one-piece hair cap shape or an assembly consisted of a plurality of triangle ceramic papers joined to one another by sewing or adhesive bonding.

The ceramic paper cap 3 serves as a heat insulating layer between the inner cap 2 and the outer cap 4 and also, has a multiplicity of projections 8 and 9 arranged at equal intervals on the inner and outer surfaces thereof respectively thus providing spaces 6 and 7 for stimulating the emission of far infrared rays.

The outer cap 4 is coated on its inner side with a silver metallic layer containing a powder of alumina for reflection of the far infrared rays emitted from the ceramic paper cap For use, the hair cap 1 is placed over the hair rolled on lots by extending its opening 10.

After placement, the escape of an unwanted ammonia gas is prevented. Also, the ceramic paper cap 3 acts as a heat insulating material to avert the loss of heat and efficiently emits the far infrared so that the duration required for setting waves or curls of the hair can be minimized.

When used in bathing, the hair cap 1 produces a heating effect as a result of the far infrared rays emitted from the ceramic paper cap 3 thus metabolizing the skin of a user and contributing to shiny hair and healthy skin.

When used after massaging the head skin with application of a hair treatment liquid to the hair, it will encourage a hair care action.

Other embodiments of the present invention will now be described referring to FIGS. 6 to 13. For ease of the description, like components are denoted by like numbers used to describe the first embodiment.

Figure 6:
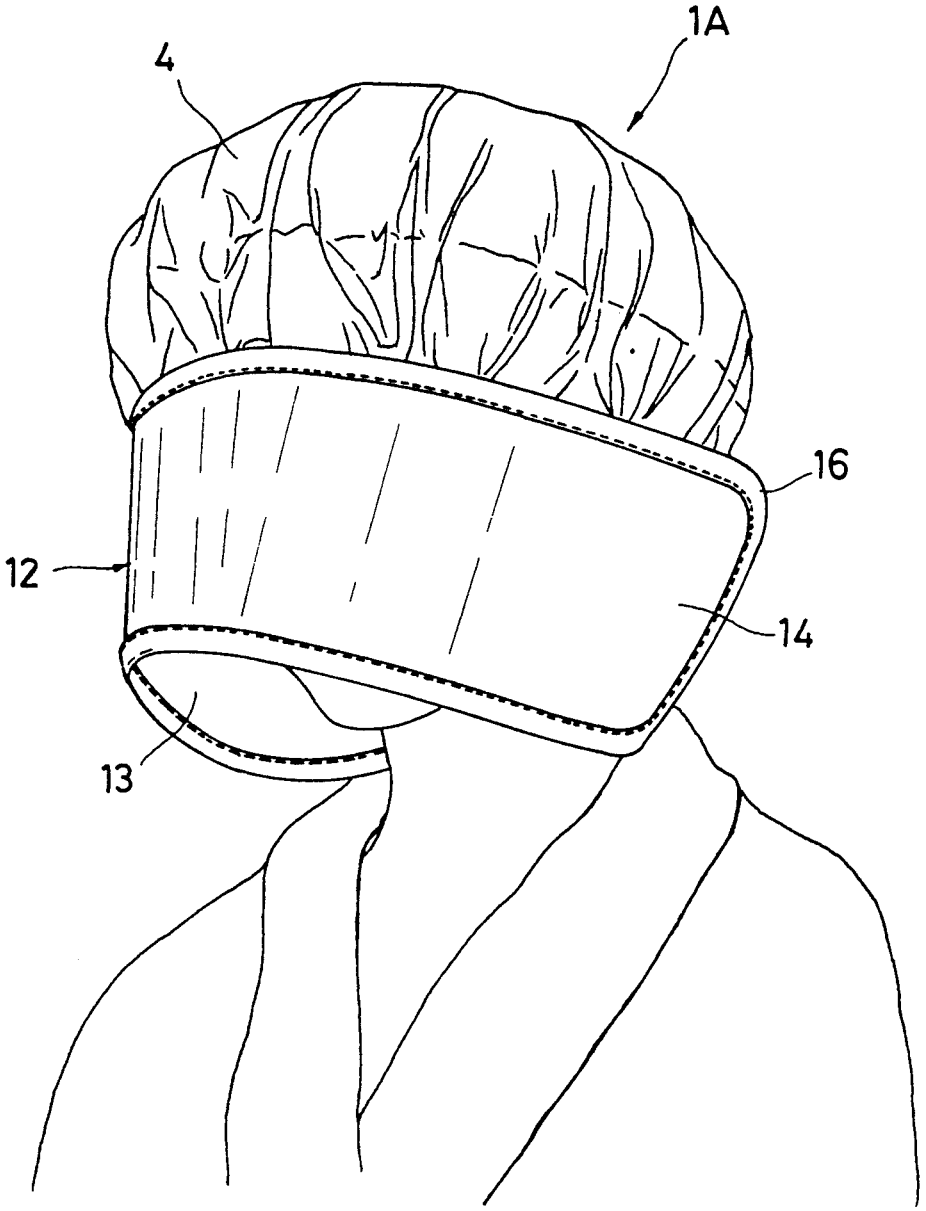
FIGS. 6 to 8 are explanatory views showing a second embodiment of the present invention.
Figure 7:
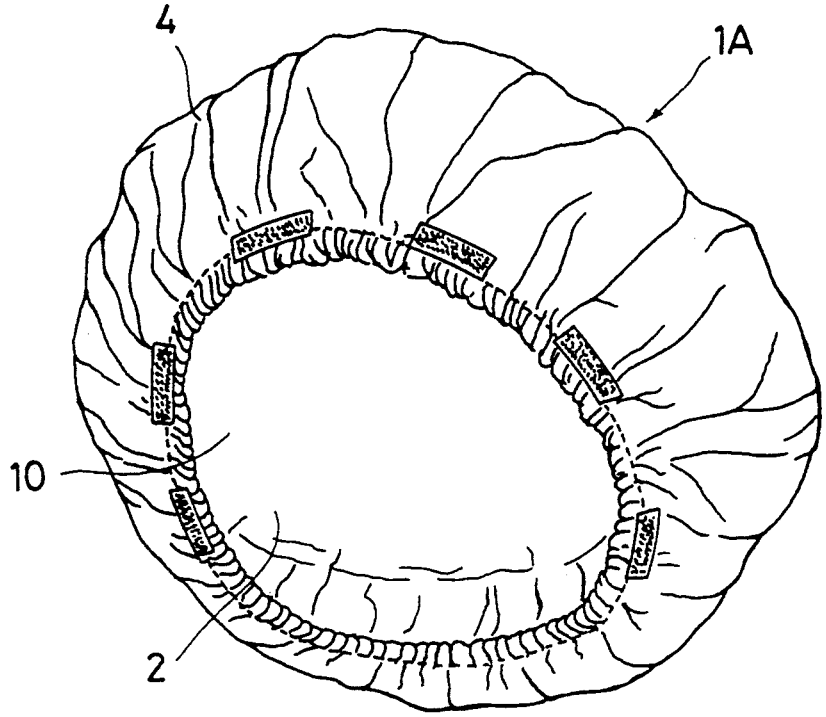
Figure 8:
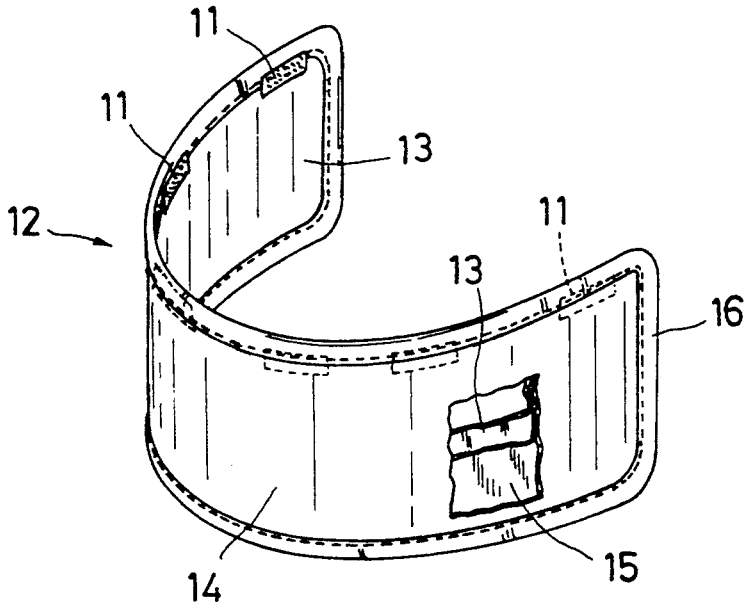

As shown in FIGS. 6 to 8, a second embodiment of the present invention differs from the first embodiment by the fact that a face shield 12 is detachably mounted by face fasteners 11 to the opening end of the outer cap 4 thus forming a hair cap 1A. When used in bathing, the hair cap 1A with the face shield 12 will encourage metabolization in the skin of the face.

The face shield 12 is made of an inner sheet 13 made of a black colored synthetic resin material, an outer sheet 14 which is a silver metallic color, a ceramic paper sheet 15 sandwiched between the inner sheet 13 and the outer sheet 14, and an edge frame 16 sewed down to the outer edge of those sheets, and provided at the inner side of the inner sheet 13 with the face fasteners 11 for fastening.

Figure 9:
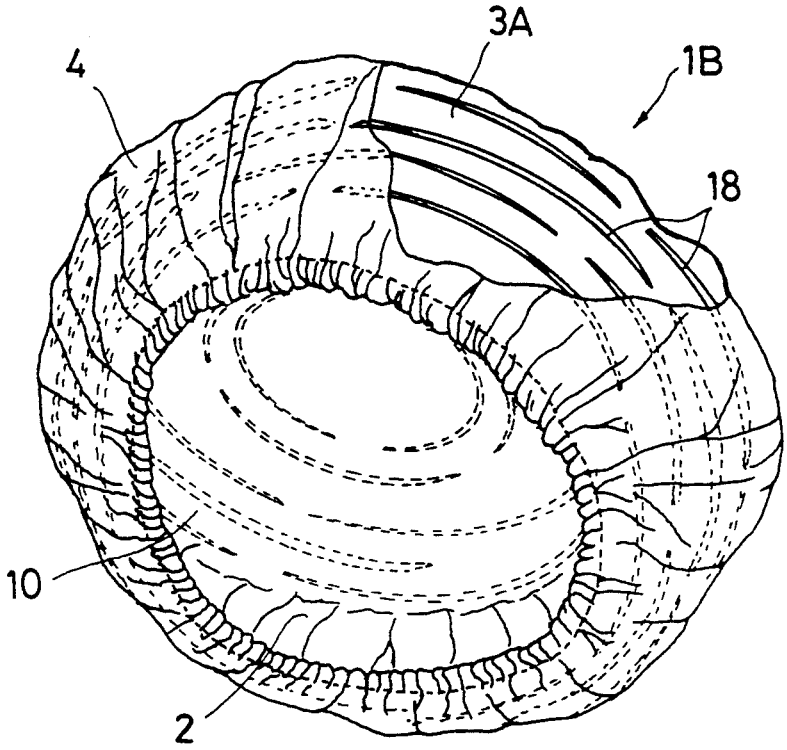
FIGS. 9 to 11 are explanatory views showing a third embodiment of the present invention.
Figure 10:
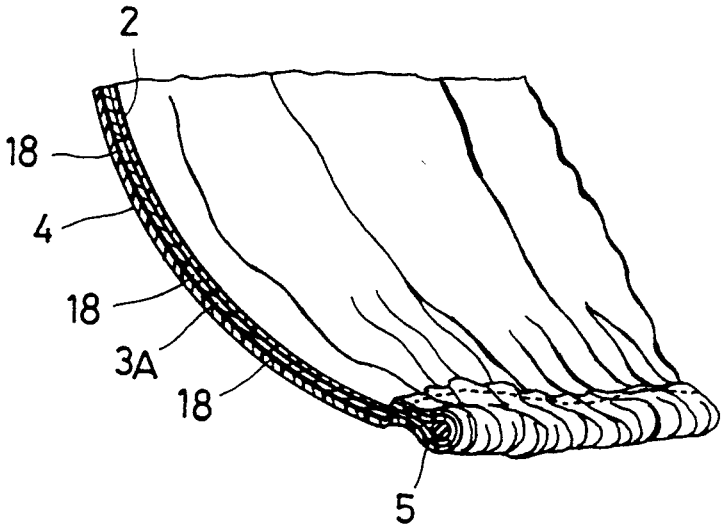
Figure 11:
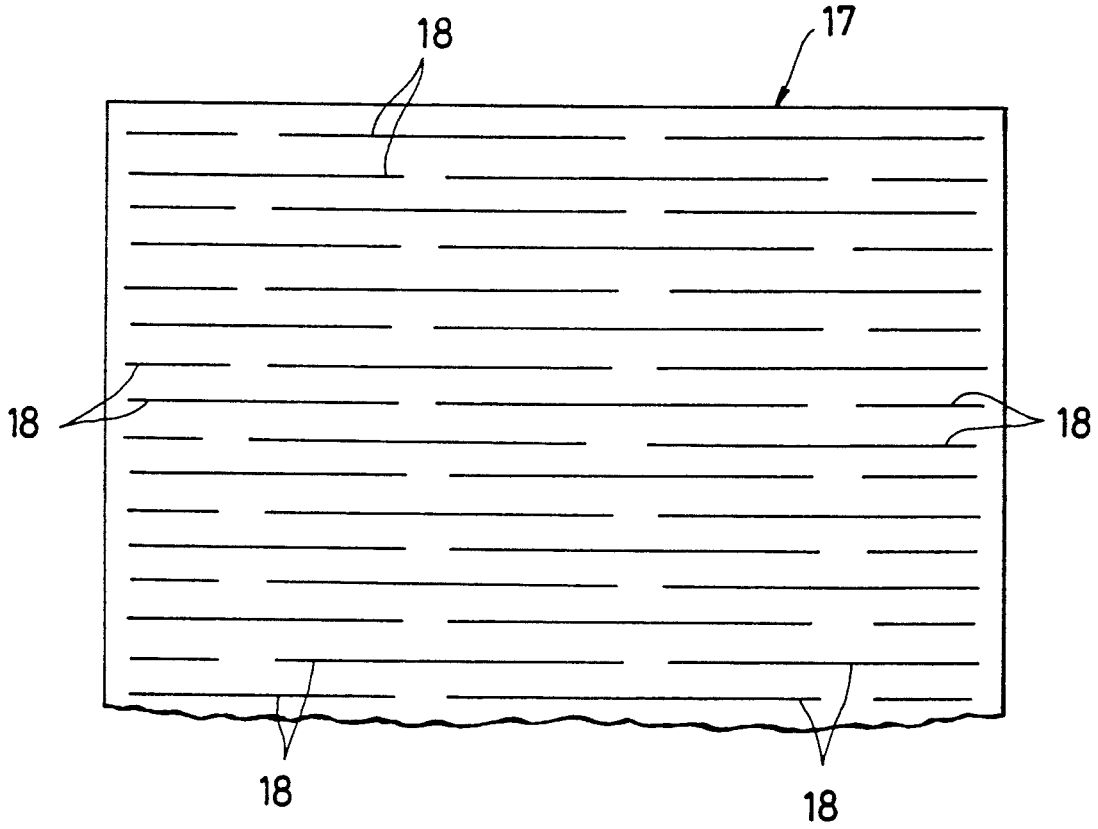

As shown in FIGS. 9 to 11, a third embodiment of the present invention differs from the first embodiment by the fact that the ceramic paper cap 3 is replaced with a ceramic paper cap 3A formed, as best shown in FIG. 11, in which a ceramic paper sheet 17 has a multiplicity of parallely assigned slits 18 arranged therein so that each two neighboring slits are unaligned with each other and is shaped into a dome configuration by stretching to enclose the inner cap 2. A hair cap 1B of the third embodiment containing the ceramic paper cap 3A will provide the same advantages as the first embodiment.

Figure 12:
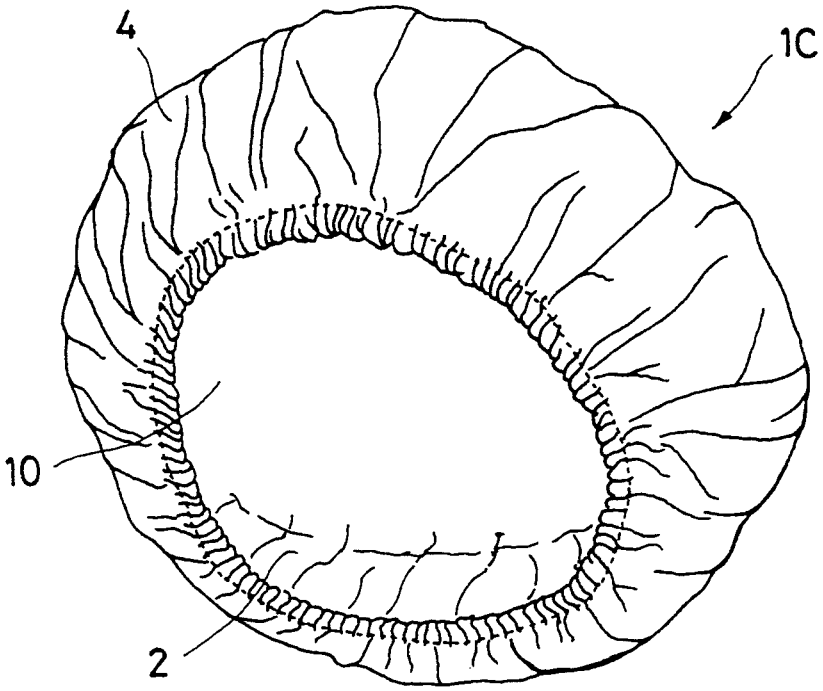
FIGS. 12 and 13 are explanatory views showing a fourth embodiment of the present invention.
Figure 13:
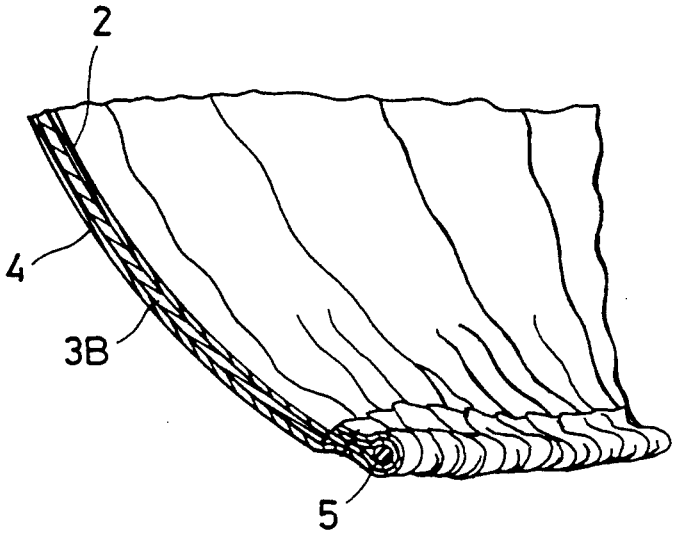

As shown in FIGS. 12 and 13, a fourth embodiment of the present invention differs from the first embodiment by the fact that the ceramic paper cap 3 is replaced with a ceramic paper cap 3B which has a dome shape with no projections. A hair cap 1C of the fourth embodiment containing the ceramic paper cap 3B will also provide the same advantages as the first embodiment.

As set forth above, the present invention provides the following advantages.

(1) The hair cap comprises an inner cap made of an impermeable synthetic resin material for placement over the head top, a ceramic paper cap of a far infrared ceramic paper material covering the inner cap, and an outer cap of an impermeable synthetic resin material covering the outer surface of the ceramic paper cap and coupled at the opening end to the inner cap. In use after completion of a winding procedure of permanent wave hairdressing, the hair cap closely protects the hair to which a hair treatment liquid has been applied for stimulation of waving or curling so that the action of the hair treatment liquid can be expedited with the help of human body heat and uniformly effected to the entirety of the hair and also, the escape of an unwanted ammonia gas vapored from the volatile hair treatment liquid can be prevented.

(2) According to the arrangement depicted in paragraph (1), the ceramic paper cap emits far infrared rays at a normal room temperature for application of heat to the hair. Hence, the duration of the waving or curling process can be decreased to about one-half and the resulting waves or curls will have improved resiliency. Also, no electric heater is needed and no fire-burn is expected. The hair cap will thus be practical without using bulky devices.

(3) According to the arrangement depicted in paragraph (1), the ceramic paper cap is thin and light weight so that the hair cap can be compact in size and light in weight.

(4) According to the arrangement depicted in paragraph (1), the ceramic paper cap which tends to be easily damaged is protectively sandwiched between the inner and the outer caps made of impermeable resin material. Hence, the hair cap avoids contamination and can be easily used without requiring the replacement of any components.

(5) The other embodiments described in the present specification will provide advantages similar to those depicted in the preceding paragraphs (1) to (4).

What is claimed is:

1. A hair cap comprising: an inner cap formed of an impermeable resin material for placement over the head of a user; a ceramic paper cap of a far infrared ceramic paper material covering over the outer surface of the inner cap; and an outer cap of an impermeable resin material covering the outer surface of the ceramic paper cap and coupled at the opening end to the opening end of the inner cap.

2. A hair cap according to claim 1, wherein the inner cap is formed of a black colored synthetic resin, selected from the group consisting of impermeable polyethylene and vinyl, which is high in the transmission of far infrared rays.

3. A hair cap according to claim 1, wherein the ceramic paper cap has a multiplicity of projections provided at equal intervals on both the inner and outer sides thereof so that it can be spaced by a given distance from the outer surface of the inner cap and the inner surface of the outer cap.

4. A hair cap according to claim 1, wherein the outer cap is formed of an impermeable synthetic resin, selected from the group consisting of polyethylene and vinyl coated with a silver metallic layer containing a powder of alumina.

5. A hair cap comprising: an inner cap formed of an impermeable resin material for placement over the head of a user; a ceramic paper cap of a far infrared ceramic paper material covering over the outer surface of the inner cap; an outer cap of an impermeable resin material covering the outer surface of the ceramic paper cap and coupled at the opening end to the opening end of the inner cap; and a face shield containing a ceramic paper material and detachably mounted to the outer cap for protecting the face of the user.

6. A hair cap according to claim 5, wherein the face shield comprises a ceramic paper sheet, an inner sheet of an impermeable synthetic resin material covering the inner surface of the ceramic paper sheet, an outer sheet of an impermeable synthetic resin material covering the outer surface of the same, and joiners for detachably mounting the face shield to the outer cap.

* * * * *